United States Patent [19]

Menke et al.

[11] Patent Number: 4,820,449

[45] Date of Patent: Apr. 11, 1989

[54] CLEANING BLOCK FOR FLUSH TOILET TANKS

[75] Inventors: Ronald Menke, Mettmann; Bernd-Dieter Holdt, Duesseldorf; Gerd Praus, Krefeld, all of Fed. Rep. of Germany

[73] Assignee: Henkel Kommanditgesellschaft auf Aktien, Duesseldorf, Fed. Rep. of Germany

[21] Appl. No.: 124,693

[22] Filed: Nov. 24, 1987

[30] Foreign Application Priority Data

Nov. 24, 1986 [DE] Fed. Rep. of Germany ..... 3640090

[51] Int. Cl.[4] ..... C11D 17/00

[52] U.S. Cl. ..... 252/544; 252/106; 252/174; 252/174.14; 252/174.18; 252/546; 252/550; 252/DIG. 16

[58] Field of Search ..... 252/DIG. 16, 544, 134, 252/174, 174.18, 174.14, 106, 107, 110, 117, 121, 546, 531, 550; 4/227, 228; 264/75

[56] References Cited

U.S. PATENT DOCUMENTS

| | | | |
|---|---|---|---|
| 3,540,899 | 11/1970 | Alper et al. | 106/58 |
| 4,043,931 | 8/1977 | Jeffrey et al. | 252/93 |
| 4,217,234 | 8/1980 | Krisp et al. | 252/102 |
| 4,224,266 | 9/1980 | Hunt et al. | 252/134 |
| 4,252,694 | 2/1981 | Lewis et al. | 252/106 |
| 4,460,490 | 7/1984 | Barford et al. | 252/92 |

FOREIGN PATENT DOCUMENTS

| | | |
|---|---|---|
| 2061996 | 2/1981 | United Kingdom . |
| 2169612 | 7/1986 | United Kingdom . |

*Primary Examiner*—Paul Lieberman
*Assistant Examiner*—Hoa Van Le
*Attorney, Agent, or Firm*—Ernest G. Szoke; Wayne C. Jaeschke; Real J. Grandmaison

[57] ABSTRACT

A cleaning block for the tank of flush toilets comprising: 10 to 30% by weight of monoalkyl sulfate, Na salt, 5 to 40% by weight of fatty acid alkanolamide, and 15 to 60% by weight of a water-soluble inorganic alkali salt, and optionally calcium-complexing carboxylic acids or alkali salts thereof, perfume, dye and other auxiliaries. The block is distinguished by a particularly long useful life, by uniform dissolving behavior and by high cleaning power. A method for use and process for manufacture are also afforded.

32 Claims, No Drawings

CLEANING BLOCK FOR FLUSH TOILET TANKS

BACKGROUND OF THE INVENTION

1. Field of the Invention

This invention relates to the composition of cleaning blocks to be placed in the tanks of automatic flush toilets, their use, and their manufacture.

2. Statement of Related Art

For automatically cleaning flush toilets operating with a reservoir tank, it has long been standard practice to use block-form cleaners which are placed or suspended in the cistern and which release their active ingredients to the flushing water over a prolonged period. Products which may be used without further aids, i.e. which may be directly thrown into the cistern, are particularly simple to handle. Cleaners such as these, which are generally in the form of blocks or tablets, have adequate useful lives by virtue of their low dissolving rate alone. Examples of products such as these can be found in U.S. Pat. Nos. 3,540,899; 4,043,931; and 4,460,490; and in British patent document No. 2,061,996.

However, none of the known products is free from disadvantages, whether too high a dissolving rate, inadequate cohesion or inadequate adherence to the cistern wall, so that the cleaners are partially entrained by the water or totally undissolved, or demonstrate inadequate cleaning power through uneven product release.

DESCRIPTION OF THE INVENTION

Other than in the operating examples, or where otherwise indicated, all numbers expressing quantities of ingredients or reaction conditions used herein are to be understood as modified in all instances by the term "about".

The present invention affords a cleaning block which achieves better overall properties through a combination of special active ingredients in certain critically selected quantitative ratios, although the majority of these active ingredients have already been proposed for or used in products of the type in question.

More particularly, the present invention comprises a cleaning block for flush toilets, tanks or cisterns consisting essentially of, preferably consisting of:

(a) 10 to 30% by weight of at least one mono $C_{12-14}$ alkyl sulfate, Na salt;
(b) 5 to 40% by weight of at least one mono- and/or dialkanolamide of a $C_{12-18}$ fatty acid with a $C_{2-6}$ amine;
(c) 15 to 60% by weight of at least one water-soluble inorganic alkali salt;
(d) 0 to 20% by weight of at least one solid, water-soluble, low molecular weight carboxylic acid having a complexing constant for calcium above $10^1$ or an equivalent quantity of an alkali metal salt thereof;
(e) from 0 to 15% by weight of at least one perfume oil,
(f) from 0 to 20% by weight of at least one water-soluble dye,
(g) from 0 to 5% by weight of at least one antimicrobial agent; and
(h) from 0 to 10% by weight of at least one auxiliary.

The present invention also relates to the method of using the inventive block as a slowly dissolving source of toilet cleaner in the cistern or tank of a flush toilet, and to a process for its production.

The cleaning blocks according to the invention are distinguished above all by a particularly uniform dissolving rate; i.e. irrespective of the extent to which the cleaning blocks have already dissolved, the flushing water always contains substantially the same concentration of active substances. This is especially attributable to the fact that, as they stand in the water, the blocks deliquesce to a certain extent and, in doing so, substantially compensate the loss of surface arising out of their erosion. Another remarkable factor is the firm adherence of the blocks to the tank walls, so that the blocks are not entrained by the water, even under adverse conditions such as are encountered in suction toilets operating with large quantities of water. This adherence is despite the fact that no adhesives are present, as such. Since, in addition, the blocks show no tendency towards disintegration, they have extremely long useful lives. A long useful life is particularly desirable today because cisterns are being installed in plaster (behind walls) to an increasing extent and can only be opened with difficulty. Another advantage of the formulations according to the invention is that all the active substances show high ecological compatability, i.e. ready biodegradability.

The individual constituents will now be described:

(a) Monoalkyl sulfates

The cleaning blocks contain as anionic surfactant predominantly $C_{12-14}$ monoalkyl sulfate sodium salts. The sodium salts in question are the monosodium salts of sulfuric acid semiesters of long-chain alcohols which are preferably unbranched. In particular, they are derivatives of fatty alcohols, among which cocosalkyl (especially myristyl) sulfate and lauryl sulfate are preferred. As in known in the art, because fatty alcohols are derived from natural sources, they are usually mixtures of varying chain lengths, the name given to designate a particular alcohol therefore indicating that it is predominantly a particular chain length, but possibly including at least $\pm 2$ carbon atoms. Other surfactants may be present at most in small quantities providing they do not adversely affect the properties of the blocks. However, they are preferably not present at all. The proportion of alkyl sulfates in the blocks is 10 to 30%, preferably 15 to 25% by weight.

(b) Fatty acid alkanolamide

This nonionic component is a $C_{12-18}$ fatty acid amide derived from $C_{2-6}$ alkanolamines. The amine component is preferably mono- or di-ethanolamine, while the fatty acid is preferably a $C_{12-14}$ fatty acid. Coconut oil fatty acid monoethanolamide is particularly preferred. Component (b) is present in the cleaning blocks in quantities of 5 to 40%, preferably 10 to 35% by weight.

(c) Water-soluble inorganic alkali salt

Alkali salts are the third necessary component of the cleaning blocks according to the invention. Their function is inter alia to enhance the cleaning power and to increase the specific gravity of the blocks. It is preferred to use one or more mildly acidic or alkaline or neutral alkali salts, for example sodium carbonate, sodium bicarbonate, borax, sodium sulfate and sodium chloride. Particular significance is attributed to the sodium salts and, above all, to sodium sulfate. The content of alkali salts in the cleaning blocks is 15 to 60%, preferably 20 to 55% by weight. Preferably more than 50% by weight and, more particularly, more than 70% by weight of the salts consists of sodium sulfate. Phosphates may be used in the blocks in quantities of no more than 10% by weight, but preferably not at all. The salts used may contain water of crystallization to a certain extent, but are preferably used in anhydrous form, as are all the other components.

(d) Water-soluble carboxylic acid (optional)

The cleaning blocks according to the invention may contain solid, water-soluble, low molecular weight carboxylic acids as complexing agents for calciuM in quantities of up to 20% by weight. Suitable carboxylic acids are any of those carboxylic acids of which the first complexing constant for calcium ions ($K_1$) is above $10^1$, as determined at room temperature in aqueous solution having an ionic strength of 0.2. Examples of carboxylic acids such as these are succinic acid, tartaric acid, diglycolic acid, hydroxyethyl iminodiacetic acid, nitrilotriacetic acid (NTA) and ethylenediamine tetracetic acid (EDTA). Instead of or in admixture with the carboxylic acids, equivalent quantities of the corresponding salts, particularly the alkali salts, are preferably used. Also preferred are the readily biodegradable carboxylic acids consisting solely of carbon, hydrogen and oxygen, of which the complexing constant $K_1$ is from $10^1$ to $10^4$, and salts thereof. Citric acid, malic acid and gluconic acid and, more especially, salts thereof are particularly preferred. The cleaning blocks preferably contain 1 to 15%, more preferably 3 to 10% by weight of these complexing agents, expressed in each case as free acids.

(e) Perfume oil (optional)

The cleaning blocks may contain up to 15%, preferably 3 to 8% by weight of any conventional and chemically compatible perfume oil.

(f) Water-soluble dye (optional)

This component may be present in the cleaning blocks in quantities of up to 20% by weight. The function of the dye is above all to provide a visual indication of the effectiveness of the blocks to the user. Dyes which do not diffuse prematurely from the cleaning blocks by virtue of their solubility are preferred. The dyes are preferably incorporated in quantities of 3 to 20% by weight.

(g) Antimicrobial agent (optional)

Although the products according to the invention show an excellent cleaning effect in the absence of component (g), their hygienic effect may be enhanced by the addition of antimicrobial agents. The quantity in which the antimicrobial agent is used depends to a large extent upon the effectiveness of the particular compound and may be up to 5%, preferably 0.1 to 5% by weight. Suitable antimicrobial agents are, in particular, isothiazolone mixtures or combinations of sodium benzoate and chloracetamide, although other antimicrobially active compounds, such as phenols or chlorine donors, may also be used.

(h) Other ingredients (optional)

In addition to components (a) to (g), the cleaning blocks according to the invention may contain at least one other auxiliary and/or additive, providing they do not adversely affect the properties of the blocks. Ingredients such as these include plasticizing aids, dissolution regulators, cleaning enhancers and auxiliaries which make the cleaning blocks easier to produce (production facilitator). Coating compositions which are subsequently applied to the blocks to make them easier to handle and store before use are also included in this category. The auxiliaries may be present in the blocks in quantities of up to 10%, preferably 0.1% to 5% by weight; in particular, however, they may also be absent altogether.

Where, in some cases, reference is made in the foregoing description of the individual components to the contribution made by the particular component to the properties of the cleaning blocks, such references are only meant to be interpreted as an indication of a special effect. Overall, every one of the components appear to contribute to a degree to each individual property of the blocks, particularly their stability, their dissolving behavior and their cleaning power. Thus, only the cooperation of the individual components in the inventive composition results in the positive properties of the new cleaning blocks.

The production of the cleaning blocks according to the invention is made particularly easy by the fact that all the solid raw materials are available in the form of fine powders and, as a result, may readily be thoroughly mixed in simple mixers, such as drum mixers, Lodige mixers or paddle mixers, and the like. The liquid components may be introduced during the mixing process without the mixture becoming lumpy. A free-flowing, substantially homogeneous premix is formed and may readily be transported by screw conveyors to an extruder (plodder) in which it is extruded into compact strands (noodles). This procedure eliminates the need for energy-intensive steps, such as heating and kneading.

The extruded strands are preferably given a square or rectangular form, so that cube-shaped or bar-shaped cleaning blocks can be produced therefrom. This shape is particularly preferred because it provides for an optional contact surface in the cistern and, hence, for firm adherence. The cleaning blocks preferably have weights of 50 to 150 g and densities of 1.2 to 1.7 g/cm$^3$.

The cleaning blocks are used by placing one or more cleaning blocks in the tank or cistern of the flush toilet. The blocks are then adhered to the side of the tank by applying pressure or to the bottom under their own weight. The cleaning power is then automatically developed through slow dissolution of the blocks in the water and transport of the dissolved active substances with the water into the toilet bowl.

EXAMPLES

1. Production of cleaning blocks A to E

The formulations of blocks A to E comprised the components shown below in Table 1:

TABLE 1

| Constituents (in % by weight) | A | B | C | D | E |
|---|---|---|---|---|---|
| Sodium lauryl sulfate | 22.0 | 19.0 | 22.0 | 19.0 | 22.0 |
| Coconut oil fatty acid monoethanolamide | 12.0 | 35.0 | 11.0 | 10.0 | 14.0 |
| Borax (10 $H_2O$) | 2.0 | — | 2.0 | 2.0 | 2.0 |
| Sodium sulfate, anhydrous | 48.0 | 18.0 | 48.37 | 48.0 | 44.0 |
| Sodium carbonate | — | 2.0 | — | — | — |
| Trisodium citrate, anhydrous | 5.0 | 5.0 | 5.0 | — | 4.0 |
| Citric acid anhydrate powder | — | — | — | — | 2.0 |
| Sodium gluconate | — | — | — | 5.0 | — |
| Pine oil 70, French | 6.0 | 4.0 | 4.0 | — | — |
| Isobornyl acetate | — | 2.0 | 2.0 | — | — |
| Honeysuckle note 81-2467 | — | — | — | 6.0 | — |
| Acidofix TM apple bouquet, acid-stable+ | — | — | — | — | 6.0 |
| Basacid Blue 755 (C.I. 42090) | 5.0 | 15.0 | 5.0 | 2.0 | 4.5 |
| Basacid Yellow 226 (C.I. 45350) | — | — | — | 8.0 | 1.5 |

TABLE 1-continued

| Constituents (in % by weight) | A | B | C | D | E |
|---|---|---|---|---|---|
| Kathon TM 886 MW++ antimicrobial | — | — | 0.42 | — | — |
| Kathon TM 893++ antimicrobial | — | — | 0.21 | — | — |

+A trademark of Haarmann und Reimer, Holzminden, Germany
++A trademark of Rohm and Haas, Philadelphia for isothiazolone compounds (aqueous solutions)

In each case, production was carried out on an pilot scale using 150 kg batches. The solid components were premixed together for 2.5 minutes in a 500-liter-capacity paddle mixer before the perfume oil and the optional aqueous solution of the antimicrobial agents were sprayed on to the stirred mixture over a period of about 1 minutes. The free-flowing, granular premix formed was then delivered by means of a vibrating chute conveyor to a twin-screw extruder and extruded into a compact strand having a square cross-section of approx. 11.5 $cm^2$. Bar-shaped blocks weighing 50 and 100 g were cut by means of an automatic knife.

2. Testing of useful life

The useful life of the cleaning blocks was tested in an automatically controlled toilet which released the contents of its tank at intervals of one hour and refilled the tank with 9 liters of tapwater measured as having a hardness of 17° Gh and a temperature of approx. 15° C. One block at a time was placed in the cistern and the number of flushes that were possible before the block was used up were counted. Table 2 shows the rounded-off results obtained in five parallel tests.

TABLE 2

| Formulation (Example 1) | A | B | C | D | E |
|---|---|---|---|---|---|
| Weight of the block (g) | 50 | 100 | 50 | 50 | 50 |
| Number of flushes possible | 700–800 | 2000 | 650 | 600 | 500–600 |

The extremely long useful lives in every case were made possible inter alia by the fact that the blocks adhered firmly to the bottom of the tank and did not disintegrate until they had been completely used.

3. Testing of active-substance release

The release of active substances was determined in a suction toilet, of the type commonly encountered in the U.S.A., by colorimetric measurement of the dye concentration in the flushing water. In this case, the capacity of the tank was 14 liters; in addition, 5 liters of fresh water were released through the cistern with each flushing (at intervals of 1 hour). Table 3 shows the results of the measurements performed with a block according to Example 1B in the course of use.

TABLE 3

| Number of flushes | Dye content of the flushing water in the toilet (ppm) |
|---|---|
| 20 | 0.9 |
| 100 | 0.3 |
| 500 | 0.45 |
| 850 | 0.4 |
| 945 | 0.4 |
| 1020 | 0.4 |
| 1480 | 0.36 |
| 1800 | 0.4 |
| 2000 (Product almost completely exhausted) | 0.59 |

The results show that, apart from a brief initial phase, the active substances are released substantially uniformly until they have been almost completely exhausted. This is attributable in good part to the fact that the block deliquesces very slowly and, as a result, still has a large surface towards the end in the form of a broad, flat mass. Such result is extremely critical, because it demonstrates that the uniformly mixed ingredients of the detergent block are present in the toilet water in a consistent amount. This permits the block to achieve its desired cleaning, microbicidal, deodorizing, etc., effects for virtually its entire lifetime.

We claim:

1. A cleaning block for insertion in the tank of flush toilets, consisting essentially of (all percentages being by weight and based upon the total composition weight):

(a) 10 to 30% of at least one mono- $C_{12-14}$- alkyl sulfate, sodium salt;

(b) 5 to 40% of at least one amide selected from the group consisting of monoalkanolamide of a 12 to 18 carbon atom fatty acid with a 3–6 carbon atoms amine, and a dialkanolamide of a 12 to 18 carbon atom fatty acid with a 2 to 6 carbon atoms amine;

(c) 15 to 60% of at least one water-soluble inorganic alkali salt;

(d) 0 to 20% of at least one solid, water-soluble, low molecular weight carboxylic acid having a complexing constant for calcium above $10^1$ as determined at room temperature in aqueous solutions having an ionic strength of 0.2, or an equivalent quantity of an alkali salt thereof;

(e) 0 to 15% of at least one perfume oil;

(f) 0 to 20% of at least one water-soluble dye;

(g) 0 to 5% of at least one antimicrobial agent; and (h) 0 to 10% of at least one auxiliary.

2. The cleaning block of claim 1 wherein (a) consists essentially of fatty alcohol derivatives.

3. The cleaning block of claim 1 wherein (a) consists essentially of at least one alkyl sulfate salt selected from the group consisting of sodium cocosalkyl sulfate and/or lauryl sulfate, sodium salts.

4. The cleaning block of claim 1 wherein (b) consists essentially of at least one $C_{12-14}$ fatty acid amide derived from mono- or di-ethanolamine.

5. The cleaning block of claim 1 wherein (b) consists essentially of coconut oil fatty acid monoethanolamide.

6. The cleaning block of claim 1 wherein (c) consists essentially of one or more of sodium carbonate, sodium bicarbonate, borax, sodium sulfate, or sodium chloride.

7. The cleaning block of claim 1 wherein more than 50% by weight of (c) consists essentially of sodium sulfate.

8. A cleaning block of claim 1 containing a calcium complexing effective amount of (d) consisting essentially of at least one carboxylic acid having a complexing constant for calcium of $10^1$ to $10^4$.

9. A cleaning block of claim 1 containing a calcium complexing effective amount of (d) consisting essentially of at least one of succinic, tartaric, diglycolic, hydroxyethyliminodiacetic, nitriloacetic, ethylenediaminetetracetic, citric, malic, or gluconic acid, or an alkali salt thereof.

10. A cleaning block of claim 1 containing a calcium complexing effective amount of (d) consisting essentially of at least one of citric, malic, or gluconic acid, or an alkali salt thereof.

11. A cleaning block of claim 1 containing a fragrance enhancing amount of (e).

12. A cleaning block of claim 1 containing a visual indicating effective amount of (f).

13. A cleaning block of claim 1 containing a hygienic effect enhancing amount of (g) consisting essentially of at least one of: isothiazolone mixtures, combinations of sodium benzoate and chloroacetamide, or an antimicrobially active phenol or chlorine donor.

14. A cleaning block of claim 1 containing a hygienic effect enhancing amount of (g) consisting essentially of isothiazolone mixtures or a combination of sodium benzoate and chloroacetamide.

15. A cleaning block of claim containing an effective amount of (h) wherein (h) is at least one member selected from the group consisting of plasticizing aid, dissolution regulator, cleaning enhancer, production facilitator, or coating composition.

16. A cleaning block of claim 1 wherein:

(a) consists essentially of a sodium salt of a fatty alcohol sulfonate;

(b) consists essentially of at least one $C_{12-14}$ fatty acid amide derived from mono- or di-ethanolamine;

(c) consists essentially of one or more of sodium carbonate, sodium bicarbonate, borax, sodium sulfate, or sodium chloride; and containing a calcium complexing effective amount of (d) consisting essentially of at least one carboxylic acid having a complexing constant for calcium of $10^1$ to $10^4$.

17. A cleaning block of claim 16 containing a hygienic effect enhancing amount of (g) consisting essentially of at least one of isothiazolone mixtures, combinations of sodium benzoate and chloroacetamide, or an antimicrobially active phenol or chlorine donor.

18. A cleaning block of claim 1 wherein:

(a) consists essentially of cocosalkyl sulfate and/or lauryl sulfate, sodium salts;

(b) consists essentially of coconut oil fatty acid monoethanolamide;

(c) consists essentially of more than 70% sodium sulfate; and containing a calcium complexing effective amount of (d) consisting essentially of at least one of succinic, tartaric, diglycolic, hydroxyethyliminodiacetic, citric, malic, or gluconic acid, or an alkali salt thereof.

19. A cleaning block of claim 18 wherein (g) consists generally of at least one of isothiazolone mixtures, combinations of sodium benzoate and chloroacetamide, or an antimicrobially active phenol or chlorine donor.

20. The cleaning block of claim 18 wherein (d) is at least one of citric, malic, or gluconic acid, or an alkali salt thereof.

21. The cleaning block of claim 19 wherein (d) is at least one of citric, malic, or gluconic acid, or an alkali salt thereof.

22. The cleaning block of claim 1 wherein the ingredients are present in:

(a) 15 to 25%;
(b) 10 to 35%; and
(c) 20 to 55%.

23. The cleaning block of claim 1 wherein the ingredients are present in:

(a) 15 to 25%;
(b) 10 to 35%;
(c) 20 to 55%;
(d) 3 to 10%.

24. The cleaning block of claim 1 wherein the ingredients are present in:

(a) 15 to 25%;
(b) 10 to 35%;
(c) 20 to 55%;
(d) 3 to 10%; and
(e) 0.1 to 5%.

25. The cleaning block of claim 16 wherein the ingredients are present in:

(a) 15 to 25%;
(b) 10 to 35%;
(c) 20 to 55%;
(d) 3 to 10%.

26. The cleaning block of claim 18 wherein the ingredients are present in:

(a) 15 to 25%;
(b) 10 to 35%;
(c) 20 to 55%;
(d) 3 to 10%.

27. The cleaning block of claim 20 wherein the ingredients are present in:

(a) 15 to 25%;
(b) 10 to 35%;
(c) 20 to 55%;
(d) 3 to 10%.

28. The cleaning block of claim 17 wherein the ingredients are present in:

(a) 15 to 25%;
(b) 10 to 35%;
(c) 20 to 55%;
(d) 3 to 10%; and
(e) 0.1 to 5%.

29. The cleaning block of claim 19 wherein the ingredients are present in:

(a) 15 to 25%;
(b) 10 to 35%;
(c) 20 to 55%;
(d) 3 to 10%; and
(e) 0.1 to 5%.

30. The cleaning block of claim 21 wherein the ingredients are present in:

(a) 15 to 25%;
(b) 10 to 35%;
(c) 20 to 55%;
(d) 3 to 10%; and
(e) 0.1 to 5%.

31. A method for cleaning a flush toilet comprising placing the cleaning block of claim 1 in a tank or cistern operatively connected to said toilet.

32. A process for the manufacture of the cleaning block of claim 1 comprising:

(a) mixing all dry ingredients in powder form;
(b) adding all liquid ingredients;
(c) mixing further;
(d) extruding the mixture through a plodder into a noodle; and
(e) cutting the extruded noodle into cleaning blocks.

* * * * *